United States Patent [19]

Galer

[11] Patent Number: 4,625,890

[45] Date of Patent: Dec. 2, 1986

[54] SAFETY CLOSURE FOR OPEN HEAD CONTAINERS

[76] Inventor: Herbert W. Galer, 24 Woodland Trail, Newnan, Ga. 30264

[21] Appl. No.: 785,783

[22] Filed: Oct. 9, 1985

[51] Int. Cl.[4] ..... B65D 45/32

[52] U.S. Cl. ..... 220/319; 220/306

[58] Field of Search ..... 220/319, 320, 306; 150/55; 292/256.65

[56] References Cited

U.S. PATENT DOCUMENTS

| | | | |
|---|---|---|---|
| 3,664,544 | 5/1972 | Hammes | 220/320 |
| 3,815,777 | 6/1974 | Churan | 220/306 |
| 4,111,330 | 9/1978 | Jordan | 220/319 |
| 4,347,947 | 9/1982 | Hammes | 220/319 |

*Primary Examiner*—George T. Hall

[57] ABSTRACT

A safety closure for an open head container, having an improved cap assembly comprising a plastic cap and locking ring, the plastic cap including a central web, a sealing ring and a plurality of lugs around it having inwardly protruding flanges to engage the lower portion of a chime on the container, the locking ring extending over the sealing ring and engaging a lower peripheral surface of the sealing ring.

10 Claims, 5 Drawing Figures

SAFETY CLOSURE FOR OPEN HEAD CONTAINERS

BACKGROUND OF THE INVENTION

1. Field of the Invention

This invention relates to a container with a removable cap or lid and is more particularly concerned with a closure assembly for an open top container.

2. Description of the Prior Art

In the past, numerous containers having a volume of an pint or more, i.e. up to several gallons or more, have been devised in which a lid or cap is secured by means of flanges which engage below the chime of the open top container. If the cap or lid is molded from plastic, the maximum dimension or undercut for the lip of a snap-on-cap or lid for a typical one-gallon container is usually about 0.100 inch (about 2.5 mm) because the lid or cap must be stripped from the plastic mold. Plastic molded containers have not generally been successful in withstanding impact or shock such as may occur if the container is dropped. The relatively insecure seal between the lid and container has been a particular weakness of interest to government regulatory bodies concerned with accidental spills of toxic or corrosive materials. The seal should be secure when it is replaced after a partial use for dispensing, for example a swimming pool chlorinating compound which may continue to be of interest to curious children.

The present invention eliminates the problem of an insecure seal and provides a closure assembly which quite firmly locks a lid on the container and yet permits its ready removal from the container and secure replacement.

SUMMARY OF THE INVENTION

Briefly described, the present invention includes a closure having a container provided with an open cylindrical top. An annular chime at the rim or upper peripheral edges of the container protrudes outwardly from the body of the container and is provided with a lower upwardly tapered annular surface. A snap-on-cap assembly closes the top of the container, the cap being an integrally molded plastic member having a central web or circular disc surrounded by a downwardly opening sealing ring, the outer periphery of which is provided with circumferentially spaced, downwardly and outwardly protruding lugs.

Each lug has an inwardly protruding lockig lip or flange which engages the peripheral shoulder of the chime of the container. A locking ring clamps over the sealing ring and a tamper indicating ring is received over the surface of the disc and locking ring.

Accordingly, it is an object of the present invention to provide a snap-on-cap lid assembly for a container which is inexpensive to manufacture, durable in structure and efficient in operation.

Another object of the present invention is to provide a closure for an open top container which can be molded using injection molding and which can be readily and easily stripped from the mold using a stripping ring and yet provides a locking lip which will sufficiently lock the cap in place so that it cannot be tampered with or readily removed.

Another object of the present invention is to provide a closure for an open top container which can be readily opened and which can also be readily closed when desired.

It is highly desirable, when the container holds a toxic or corrosive chemical such as the chlorine-containing compounds commonly used for treating home swimming pools, that after the container is reclosed it should be difficult for a child to reopen. This is another object of the present invention.

Another object of the present invention is to provide a closure assembly for an open top container which will place an O-ring in compression between the rim of the container and the cap or lid of the assembly.

Another object of the present invention is to provide a container closure system that does not require a gasket even when the container holds powders and some viscious liquids.

Another object of the present invention is to provide a closure assembly having a molded plastic cap with a locking surface which is adequate to assure that the lid assembly cannot be readily removed from the container and will not be easily dislodged even if the container is subjected to rough handling during transport, and/or to long term warehouse conditions.

Other objects, features and advantages of the present invention become apparent from the following description when taken in conjunction with the accompanying drawings wherein the characters referenced designate corresponding parts throughout the several views.

DETAILED DESCRIPTION

Figure 1:
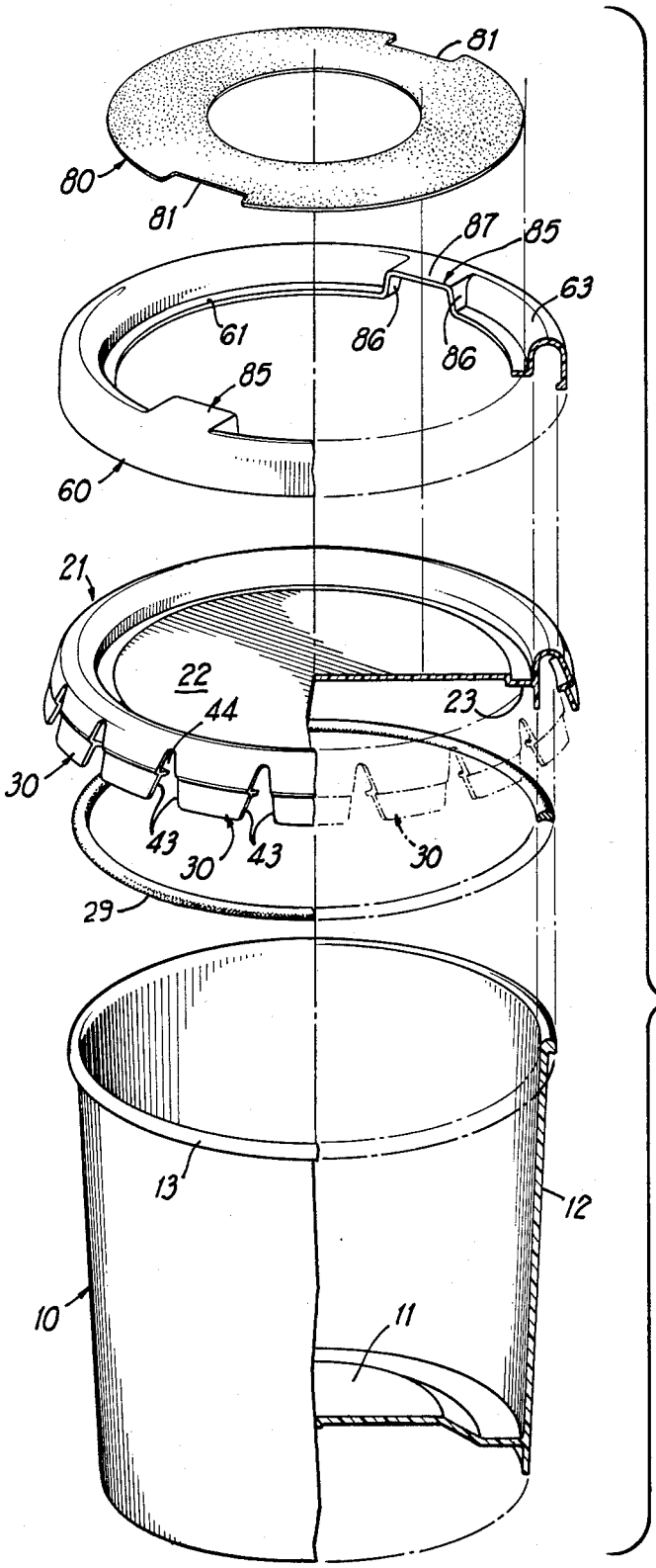
FIG. 1 is an exploded perspective view of a container constructed in accordance with the present invention.
Figure 3:
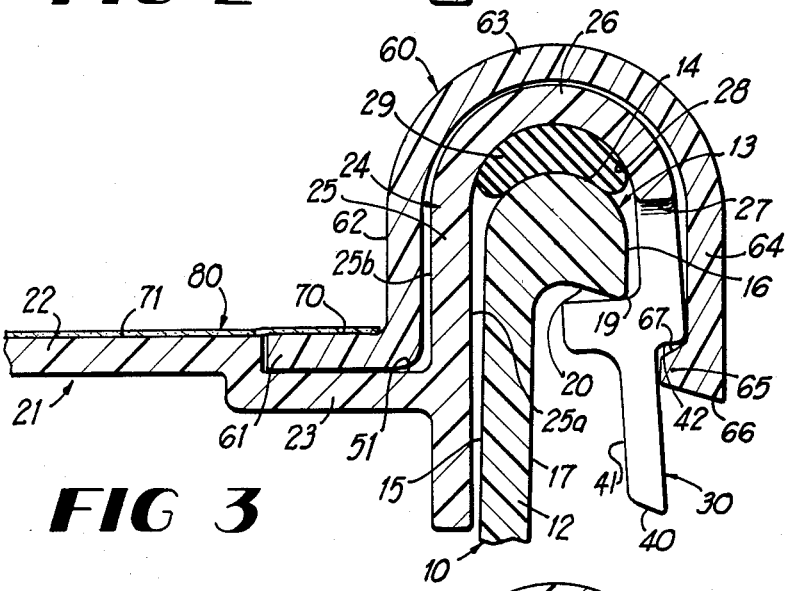
FIG. 3 is an enlarged fragmentary vertical sectional view of a portion of the rim of the container with the lid assembly installed thereon.

Referring now in detail to the embodiment chosen for the purpose of illustrating the present invention, numeral 10 in FIG. 1 denotes generally a bucket or container having a bottom 11 and an upstanding cylindrical or downwardly tapered wall 12, the upper end of which terminates in an open top defined by an outwardly protruding annular rim or chime 13. As seen in FIG. 3, the upper edge portion of the chime 13 in cross-section is convex to provide a curved upwardly and outwardly protruding surface denoted by the numeral 14. This surface 14 on its inner side merges with the inner surface 15 of the wall 12. The upper surface 14 also merges on its outer side with the outer surface 16 of the chime 13. The outer surface 16 is spaced outwardly from the outer surface 17 of the wall 12 and is disposed generally concentric to the walls 15 and 17. A lower annular lip 20 forms the bottom portion of the chime 13, this lip 20 tapering outwardly and downwardly and merging at an outer annular edge 19 with the outer wall 16 of the chime 13. The inner edge portion of the lip 20 curves inwardly and downwardly in an arcuate fashion to merge with the outer wall 17.

Referring again to FIG. 1, the lid or cap assembly includes a cap denoted generally by the numeral 21, this cap 21 having a flat central disc shaped web 22 which extends across essentially the entire mouth of the container 10 when the container is closed. The periphery of the web 22 is integrally joined in an annular support ring 23 which is disposed in a plane below the plane of the web 22. As seen more clearly in FIG. 3, the inner peripheral portion of the support ring 23 carries the outer peripheral portion of the web 22 while the outer periphery of the support ring 23 is integrally joined to an intermediate portion of the inner wall member 25 of an upstanding sealing ring denoted by the numeral 24. This sealing ring 24 opens downwardly. The inner wall member 25 of the sealing ring 24 is generally cylindrical and has an outer surface 25*a* which conforms to and fits snugly against and within the inner surface 15 of the container 12 when the cap 21 is appropriately placed for closing the open upper end of the container 10.

The upper edge portion of the inner wall 25 integrally merges with an annular top portion 26 which extends over the upper surface 14 of the chime 13, the annular top portion 26 being essentially semi-cylindrical in cross section, as shown in FIG. 3, and terminating at a lower edge 27 which is spaced above the upper edge portion of the outer wall 16 but below the upper extremity of the surface 14. The inner surface 28 of the annular top portion, in cross-section is concaved and conforms generally to the shape of the upper surface 14, being slightly larger in cross-sectional diameter than the surface 14. Thus, an O-ring 29 placed on upper surface 14 can be clamped in compression as shown in FIG. 3 between the surface 28 and the surface 14 when the lid assembly is installed on container 10.

Figure 2:
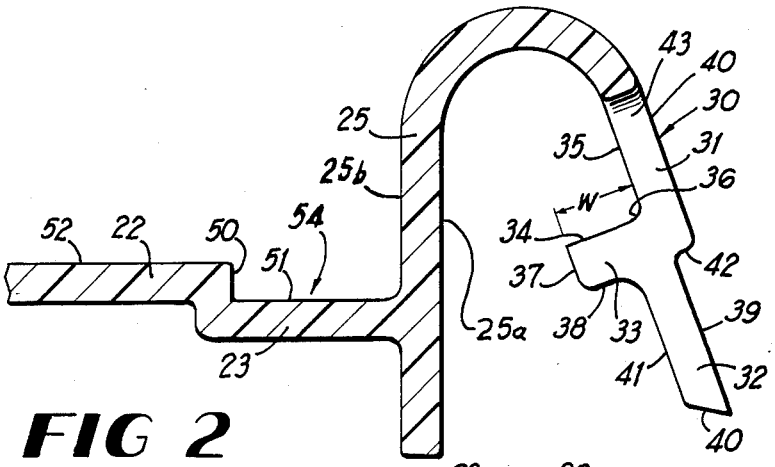
FIG. 2 is enlarged fragmentary vertical sectional view of a portion of the cap or lid of the container shown in FIG. 1.

Protruding downwardly from the edge 27 are a plurality of circumferentially equally spaced locking lugs 30 which are arranged adjacent to each other circumferentially around the cap 21. Each locking lug 30 is substantially identical and when molded protrudes at an angle outwardly and downwardly from the top portion 26, as illustrated in FIG. 2 at an angle of from 10° to 70° to the vertical axis. Each lug 30 includes a body 31 which carries a releasing lever 32 as an extension of the body 31, the releasing lever 32 being integrally formed with and spaced downwardly from the body 31.

Protruding inwardly from the lower end portion of the body 31 is a locking lip 3 which has a relatively wide flat upper or locking surface 34 which merges along a concaved portion 36 with the vertical inner surface 35 of the body 31. This flat locking surface 34 has any reasonable width W and terminates at the inner edge 36 of the ledge 33. The inner vertical surface 35 protrudes downwardly forming a locking surface extremity 37 and then curves outwardly to merge with the bottom surface 38 of the locking ledge 33, this bottom surface, in turn, curving downwardly and merging with the inner surface 41 of the lever 32. The inner surface 41 is offset inwardly from the inner surface 35 of the boey 31 and protrudes downwardly to merge with a stripper ring engaging surface 40 which is disposed at an obtuse angle to the surface 41 as shown in FIG. 2 and FIG. 3. This stripper ring engaging surface or lower surface 40 protrudes outwardly and merges with the outer surface 39 of the lever 32.

The upper edge portion of the outer surface 39 terminates at the inner edge of a shoulder 42 which is disposed essentially in a common place with the bottom surface 38 and this shoulder 42 protrudes outwardly and then curves upwardly to merge with the outer surface 40 of the body 31.

Referring to FIG. 1, it is seen that each of the lugs 30 is provided with a pair of side edges 43, the side edges of adjacent lugs tapering upwardly to provide a generally triangular space 44 therebetween which is adapted to receive a screwdriver when the lid is to be removed by being pushed off.

Referring now to the FIG. 2, it will be seen that the web 22 has an outer periphery 50 which is a cylindrical surface above the support ring 23. The lower edge of the outer periphery 50 terminates at the inner periphery of the flat annular upper surface 51 of the support ring 23, this upper surface 51 terminating at the surface 25*b*. Thus, the surfaces 50, 51 and 25*b* define an annular recess 54 which receives the inner annular flange 61 of a locking ring 60. The inner flange 61 has an outer pheriphery which is intregally joined to an upstanding inner wall 62 of the locking ring 60. This inner wall 62 is adapted to be received against the upper portion of wall 25*b* when the locking ring 60 is installed.

It will be understood that the locking ring 60 is a downwardly opening annular member which include an annular outer wall 64 which is generally concentric with and outward from the wall 62. Between the wall 64 and the wall 62 is a downwardly opening curved top portion 63 which, in cross section, is essentially semi-cylindrical and extends over the top portion 26 when the locking ring 60 is installed. At the lower edge portion of the outer annular wall 64 is an inwardly protruding rim 65 having a downwardly tapered lip engaging surface 67. The bottom surface 66 of the lip 65 is adapted to engage below the ledge 42 when the locking ring 60 is installed as shown in FIG. 3.

When the locking ring 60 is installed over the sealing ring 21, it cams all of the lugs 30 simultaneously inwardly so that the surface 34 is cammed along the outer corner 19 so as to terminate in the position shown in FIG. 3 beneath the lower surface 20 of the chime 13. When the locking ring 60 is fully installed on the sealing ring 24 the annular flange 61 is seated on the surface 51 and is received within the recess 54 so that its upper surface 70 is in a common plane with the upper surface 71 of the web 22 as shown in FIG. 3. The annular rims 65 hold all of the lugs 30 in an inwardly deformed position so at the surfaces 34 of all lugs act against the edges 19 to compress the O-ring 29 into a deformed position as shown in FIG. 3.

As shown in FIG. 1, the flange 61 is interrupted at diametrically opposed positions so as to be connected by end portions to upwardly inclined opposed pairs of sidewalls which define openings of opposed lifting handles 85. The upper ends of these sidewalls 86 merge with the ends of flat top plates 87 which are disposed in a common plane at about the upper extremity of the sealing ring. Thus, a person may insert his fingers into the space defined by the walls 86 and the plate 87 of each of the respective handle recesses and thereby remove the locking ring 60, thus providing an alternate means of removing the locking ring.

To ensure that the lid has not been previously opened, a tamper sheet 80 which is a sheet of paper or fiber board formed as an annulus is sealed by adhesive against the surfaces 70 and 71 (FIG. 3) after the locking ring has been installed on the sealing ring.

The outer peripheral portion of the sheet 80 is provided with a pair of diametrically opposed indentations 81 so that the sheet 80 will fit over the handles 85.

Figure 4:
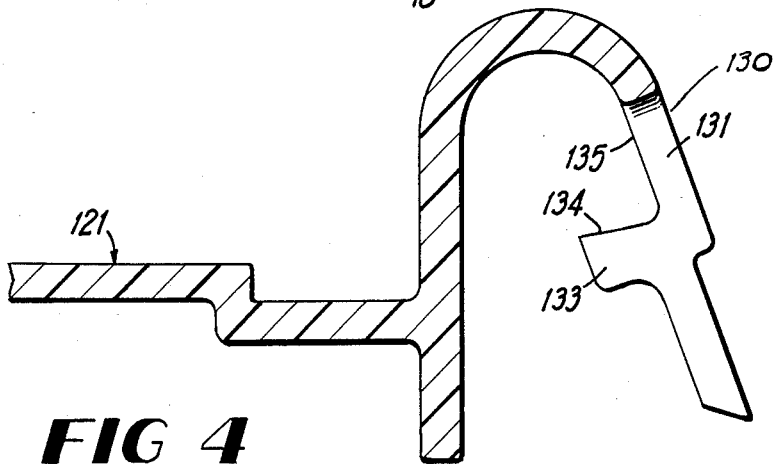
FIG. 4 is a fragmentary vertical sectional view similar to FIG. 2 and showing a modified form of the present invention.

FIG. 4 shows a modified form of the present invention in which the cap 121 is identical to the cap 21 for the lugs 130 of the sealing ring wherein the locking lip 133 has a locking ledge 134 which is disposed at an acute angle to the inner surface 135 of the body 131. Thus, when urged beneath the chime 13, this lip or ledge 134 will be disposed in an upwardly inclined surface or shoulder 20 of the chime so as to essentially lock the locking ring in place. Thus even if the locking ring 60 is removed, the lugs 130 will not spring outwardly until urged by the lever 130.

In use, the container 10 is filled, and the O-ring 29 is placed within the cap 21. The O-ring is retained within the cap because the O-ring has a cross-sectional diameter greater than the distance between surface 37, and surface 25*a*. The cap with the O-ring is placed over the top chime of the container. The locking ring 60 is then placed on top of cap sealing ring and urged down onto the sealing ring until it snaps into position. The tamper-evident sheet 80 which may contain a printed label is then glued in place over web 22 and the flange 61. Thus, all lugs 30 are cammed inwardly and locked. In opening, depending on the amount of engagement of locking surface 67, either fingers or a screwdriver may be used to remove the locking ring 60. Removal of the locking ring tears the tamper-evident seal 80. Once the locking ring is removed, the lid is lifted off by grasping the several lugs and lifting outward and upward simultaneously.

Figure 5:
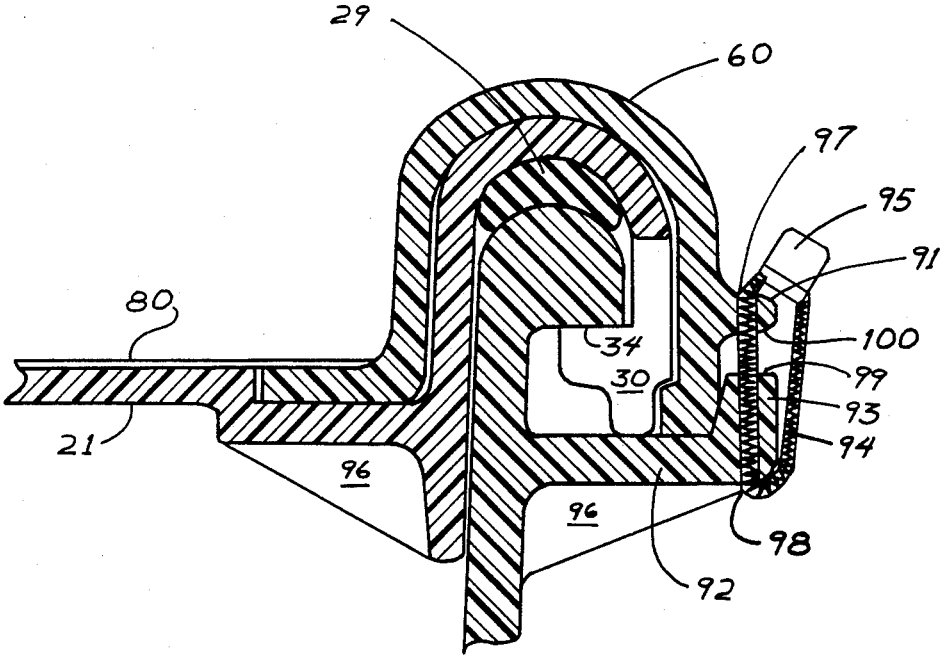
FIG. 5 is a fragmentary vertical section view of a variation of my invention having additional flange and prying means for locking and convenient opening, and an additional tamper-evident feature.

The variation in FIG. 5 shows a lug 30 having a somewhat different shape in that it has a flat surface 34 and does not have an elongated lever 32 as in FIGS. 2, 3, and 4. This is to make room for peripheral locking flange 92 which extends radially beyond both lugs 30 and outer wall 64 of locking ring 60, terminating in an upwardly extending rim 93. Locking ring 60 also has a peripheral pry flange 91 in proximity to the terminus 99 of locking flange 92 in order to provide opposing surfaces 100 and 99 for leverage. The locking flange with upward rim 93 will prevent the outward flexing of locking ring 60 if the container is stressed as by dropping.

The embodiment of FIG. 5 also shows an optional seal wire 94 passing through holes 97 and 98 in the pry flange 91 and rim 93; the wire may have a seal 95, but in any case will preferably be of a unique design not easily replaced and will of course act as additional evidence of tampering. Reinforcing ribs 96 may be spaced around the container wall and cover.

When constructed properly, my novel container can be easily reclosed by replacing the locking ring on the sealing ring; when properly replaced, the container will again meet the existing government standards for resistance to shock and re-opening either by accident or purposely.

The cap is preferably molded in a mold in which the lugs are disposed at an incline or obtuse angle to the web and are pivoted outwardly when the cup is stripped from the mold.

The lugs are preferably molded at an incline in the mold so that a stripper ring can urge the lugs outwardly in stripping the cap from the mold.

It will be obvious to those skilled in the art that many variations may be made in the embodiment here chosen for the purpose of illustrating the present invention without departing the scope thereof as defined by the appended claims.

I claim:

1. A closure assembly of the type having a container with a removable lid, said container having a sidewall and being substantially cylindrical and open at its top portion, said container having a chime carried by said wall and circumscribing said top portion, said chime protruding radially outwardly of the wall of said container and having a shoulder along its bottom portion, wherein the improvement comprises a removable plastic cap assembly for closing said open top, said cap assembly including:

(a) a removable plastic cap having (i) a central web for extending over said open top portion of said container when said cap is placed on said container, said web having a substantially circular periphery, (ii) a sealing ring fixed to said periphery of said web, said sealing ring being downwardly opening and having an annular top portion for extending over the rim of said chime when said cap closes the top portion of said container, and (iii) a plurality of lugs carried by the outer portion of said top portion, said lugs being circumferentially spaced around the periphery of said top portion of said cap for extending around said chime, each of said lugs having an inwardly protruding flange for protruding beneath a portion of said chime when said cap closes said container and said lug is moved inwardly toward said container, said lugs normally extending downwardly and outwardly from said top portion of said cap; and (b) locking ring for extending over said top portion of said sealing ring, said locking ring opening downwardly and having an inwardly extending lip for engaging beneath a portion of said sealing ring when said sealing ring is disposed beneath a portion of said locking ring, said lugs having portions which protrude downwardly between said lip of said locking ring and said wall of said container and terminating below said locking ring.

2. The closure assembly defined in claim 1 wherein said central web member includes an annular support flange secured to said sealing ring and a central web spaced inwardly from said sealing ring and supported by said support member, said central web being offset upwardly from said support member for defining an annular recess between the periphery of said web and said sealing ring and wherein said locking ring includes an inwardly protruding annular flange received within said recess and means extending over said annular flange for indicating when the annular flange has been moved with respect to said web.

3. The closure assembly defined in claim 1 whrein said locking ring has inwardly opening opposed handles along the inner portion of said locking ring.

4. The closure assembly defined in claim 1 wherein said lugs are normally inclined at an angle of between 10° and 70° and wherein said lugs are biased inwardly when said locking ring extends over the top portion of said sealing ring.

5. The closure assembly defined in claim 1 wherein said lugs include shoulders on the outer surfaces of said lug intermediate the ends of said lug and wherein said lips extend below said shoulders when said locking ring is installed over said sealing ring.

6. The closure assembly defined in claim 1 wherein adjacent lugs include sides which taper upwardly and terminate within said locking ring for receiving a lever therebetween to assist in removing said locking ring from said sealing ring.

7. The closure assembly defined in claim 1 including an O-ring between said sealing ring and said top chime of container, said O-ring being under compression when said locking ring is fully installed on said sealing ring.

8. The closure assembly of claim 1 including a peripheral locking flange on said container wall having a peripheral upwardly extending rim extending beyond and adapted to make contact with the lower terminus of the plastic cap.

9. The closure assembly of claim 1 including a peripheral locking flange having a peripheral upwardly extending rim adapted to contain the lower terminus of the plastic cap, and a peripheral prying flange above and in proximity to said locking flange to provide mutually opposing surfaces.

10. The closure assembly of claim 1 including a locking flange on said container wall adapted to contain the lower terminus of the plastic cap, a peripheral prying flange on said container wall above and in proximity to said locking flange, having at least one tamper-evident sealing means connecting said locking flange and said prying flange.

* * * * *